US009222025B2

(12) United States Patent
Kim et al.

(10) Patent No.: US 9,222,025 B2
(45) Date of Patent: Dec. 29, 2015

(54) METHOD AND DEVICE FOR COKING COAL MIXTURES HAVING HIGH DRIVING PRESSURE PROPERTIES IN A "NON-RECOVERY" OR "HEAT-RECOVERY" COKING OVEN

(75) Inventors: Ronald Kim, Essen (DE); Franz-Josef Schuecker, Castrop-Rauxel (DE)

(73) Assignee: THYSSENKRUPP UHDE GMBH, Dortmund (DE)

( * ) Notice: Subject to any disclaimer, the term of this patent is extended or adjusted under 35 U.S.C. 154(b) by 673 days.

(21) Appl. No.: 13/581,495

(22) PCT Filed: Feb. 4, 2011

(86) PCT No.: PCT/EP2011/000508
§ 371 (c)(1),
(2), (4) Date: Aug. 28, 2012

(87) PCT Pub. No.: WO2011/107198
PCT Pub. Date: Sep. 9, 2011

(65) Prior Publication Data

US 2012/0312678 A1 Dec. 13, 2012

(30) Foreign Application Priority Data

Mar. 3, 2010 (DE) ..... 10 2010 010 184

(51) Int. Cl.
*C10B 31/08* (2006.01)
*C10B 31/04* (2006.01)
(Continued)

(52) U.S. Cl.
CPC . *C10B 31/04* (2013.01); *C10B 5/00* (2013.01); *C10B 31/08* (2013.01); *C10B 57/08* (2013.01)

(58) Field of Classification Search
CPC ..... C10B 31/00; C10B 31/08; C10B 57/08; C10B 57/10; C10B 5/00
USPC ..... 201/16; 202/99, 150, 262
See application file for complete search history.

(56) References Cited

U.S. PATENT DOCUMENTS 3,047,473 A * 7/1962 Schmidt ..... 201/4
3,374,151 A * 3/1968 Schmidt ..... 201/8
(Continued)

FOREIGN PATENT DOCUMENTS

CA 2052177 3/1992
DE 658351 3/1938
(Continued)

OTHER PUBLICATIONS

International Search Report for PCT/EP2011/000508, English translation attached to original, Both completed by the European Patent Office on May 31, 2011, All together 7 Pages.
(Continued)

*Primary Examiner* — Renee E Robinson
*Assistant Examiner* — Jonathan Miller
(74) *Attorney, Agent, or Firm* — Brooks Kushman P.C.

(57) ABSTRACT

A method for coking coals having high driving pressure properties in a "non-recovery" or "heat-recovery" coking oven, wherein a coking oven battery which is composed of coking oven chambers arranged side by side is used for cyclic coking of coal, and wherein an amount of coal preheated to a high temperature is admitted into the coking chamber that is to be filled at such a level that the driving pressure resulting from the coking can escape over the coke cake into the gas chamber, in such a manner that the coking oven chamber wall surrounding the coking oven chamber is relieved by the driving pressure resulting from the coking. Also disclosed is a device with which this method can be carried out.

18 Claims, 3 Drawing Sheets

(51) Int. Cl.
*C10B 5/00* (2006.01)
*C10B 57/08* (2006.01)

(56) References Cited

U.S. PATENT DOCUMENTS

| | | | | | |
|---|---|---|---|---|---|
| 3,523,065 | A | * | 8/1970 | Schmidt | 201/40 |
| 3,753,867 | A | * | 8/1973 | Wiemer | 202/262 |
| 3,985,245 | A | * | 10/1976 | Schulte | 414/21 |
| 4,049,141 | A | * | 9/1977 | Rohde et al. | 414/161 |
| 4,179,340 | A | * | 12/1979 | Limberg et al. | 202/262 |
| 4,270,980 | A | * | 6/1981 | Shimotsuma et al. | 201/28 |
| 4,282,066 | A | | 8/1981 | Wagener et al. | |
| 4,287,024 | A | | 9/1981 | Thompson | |
| 4,344,820 | A | | 8/1982 | Thompson | |
| 4,389,283 | A | | 6/1983 | Calderon | |
| 4,460,437 | A | | 7/1984 | Corry | |
| 5,114,542 | A | | 5/1992 | Childress et al. | |
| 5,318,671 | A | | 6/1994 | Pruitt | |
| 6,033,528 | A | * | 3/2000 | Sakawa et al. | 201/1 |
| 2011/0030157 | A1 | | 2/2011 | Schuecker et al. | |
| 2011/0048919 | A1 | | 3/2011 | Kochanski et al. | |

FOREIGN PATENT DOCUMENTS

| | | |
|---|---|---|
| DE | 2706026 | 10/1977 |
| DE | 2812520 | 9/1979 |
| DE | 3247898 | 7/1983 |
| DE | 3701875 | 8/1987 |
| DE | 4204578 | 8/1993 |
| GB | 1089092 | 11/1967 |
| GB | 1555400 | 11/1979 |
| WO | 2009097984 | 8/2009 |
| WO | 2009141086 | 11/2009 |

OTHER PUBLICATIONS

D'Lima et al. 60th Ironmaking Conference Proceedings 2001, vol. 60, p. 595-602, "Sesa Energy Recovery Ovens."

Alderman et al. The American Institute of Mining, Metallurgical and Petroleum Engineers 1972, p. 193-201, "Preheating and Charging Coal to Coke Ovens."

* cited by examiner

METHOD AND DEVICE FOR COKING COAL MIXTURES HAVING HIGH DRIVING PRESSURE PROPERTIES IN A "NON-RECOVERY" OR "HEAT-RECOVERY" COKING OVEN

CROSS-REFERENCE TO RELATED APPLICATION

This application is the U.S. national phase of PCT Appln. No. PCT/EP2011/000508 filed on Feb. 4, 2011, which claims priority to German Patent Application No. 10 2010 010 184.2 filed on Mar. 3, 2010, the disclosures of which are incorporated in their entirety by reference herein.

BACKGROUND OF THE INVENTION

1. Field of the Invention

The present invention concerns a process for the coking of coal with high swelling pressure characteristics in a "non-recovery" or "heat-recovery" coke oven whereby a coke oven bank composed of coke oven chambers arranged in a row is used for the cyclical coking of coal and a quantity of coal pre-heated to a specific temperature is introduced into the coke chamber to be filled at such a load height as to allow the swelling pressure arising due to coking to be released into the gas compartment over the coke cake, so that the coke oven chamber walls surrounding the coke oven chamber can be relieved of the swelling pressure arising during coking. The invention also concerns a device with which this process can be executed.

2. Description of the Related Art

During the coking of coal, substantial pressure known as swelling pressure arises. This is exerted on the coke oven chamber walls, subjecting the coke oven chamber walls to substantial mechanical stress. Coke oven chamber walls are frequently fitted with an elaborate cross-anchoring system consisting of anchor stands, wall shields, chamber frames, bias springs and anchors. An example of a cross-anchoring system for coke oven chamber walls can be found in WO 2009141086 A1.

Swelling pressure arises during the coking of coal in the so-called plastic zone of the coke cake due to the splitting of the volatile coal components and tar, and tar seam formation arising from the meeting of plastic zones. Swelling pressure is caused by what is known as internal gas pressure, which arises in connection with the dilation and contraction of the coal. The internal gas pressure is exerted on the coke oven chamber walls via the already coked coal, as the coke first forms near the walls due to the hot coke oven chamber walls. During the coking of coal, swelling pressure can arise that is high enough to damage the coke oven chamber walls. Experience has shown that maximum swelling pressure is reached at approximately 75% of operating time, defined as the period between two loadings. As the bias springs of the cross-anchoring system serve to absorb the swelling pressures, they must be pre-stressed to a high degree, and often precisely adjusted in order to prevent damage of the coke oven chamber walls by the swelling pressure.

This entails considerable economic expense. Furthermore the coke oven chamber walls must be repaired frequently due to the influence of swelling pressure if the cross-anchoring system is improperly adjusted or has not been maintained throughout the life of an oven. Because the amount of swelling pressure depends primarily on the type of coal or mixture of types of coal used, severe limitations are often placed on the type of coal that can be used for coking. Therefore, from the very beginning such coals cannot be used for coking that are particularly well-suited for the intended use. It is also possible to reduce the swelling pressure by introducing additives to the coal to be coked. Examples of these are coke breeze with a high content of volatile components and inert dull coal. However, introducing additives is not always desirable as they may also have an undesirable effect on the utilisation processes. Finally, the coking speed also depends on the moisture content, the content of volatile coal components, the height of the load and the load weight.

At the same time, during loading the coal that is fed in must always be levelled after loading with a mechanical levelling bar to convert the conical load into an oven load with a uniform height. This homogenises the coking process. The levelling bar is introduced into the oven laterally through levelling holes in the oven door. This entails a complex design and construction.

SUMMARY OF THE INVENTION

Thus the present task is to develop a process for the coking of coal with high swelling pressure characteristics whereby the type of coal to be used can be freely selected without the need to avoid excessive swelling pressure. The moisture content, the content of volatile coal components, the load weight, the layer height, the type of coal, the maceral group of the type of coal being used and the choice of coking conditions should play no role in coking. At the same time the design and construction of intricate parts such as levelling doors and cross anchoring should become unnecessesary in order to make the coking process more economical.

The invention solves this task with a process for coking coal with high swelling pressure characteristics in a "non-recovery" or "heat-recovery" coke oven bank whereby

- a coke oven bank composed of coke oven chambers arranged in a row is used for the cyclical coking of coal,
- the coke oven chambers are loaded from a coal hopper from which the coal can be loaded into the coke oven chamber with appropriate transport equipment,
- the coal is brought to an elevated temperature of 100 to 400° C. under an inert gas, and the coal is loaded under an inert gas into the coke oven chamber,
- the pre-warmed quantity of coal is put into the coke oven chamber to be filled at a constant loading height without additional levelling so that the swelling pressure of the coking can escape into the gas compartment over the coke cake, and
- the coal is converted to coke in the designated coke oven chamber during the course of a coking cycle.

DETAILED DESCRIPTION OF THE PREFERRED EMBODIMENTS

Figure 1:
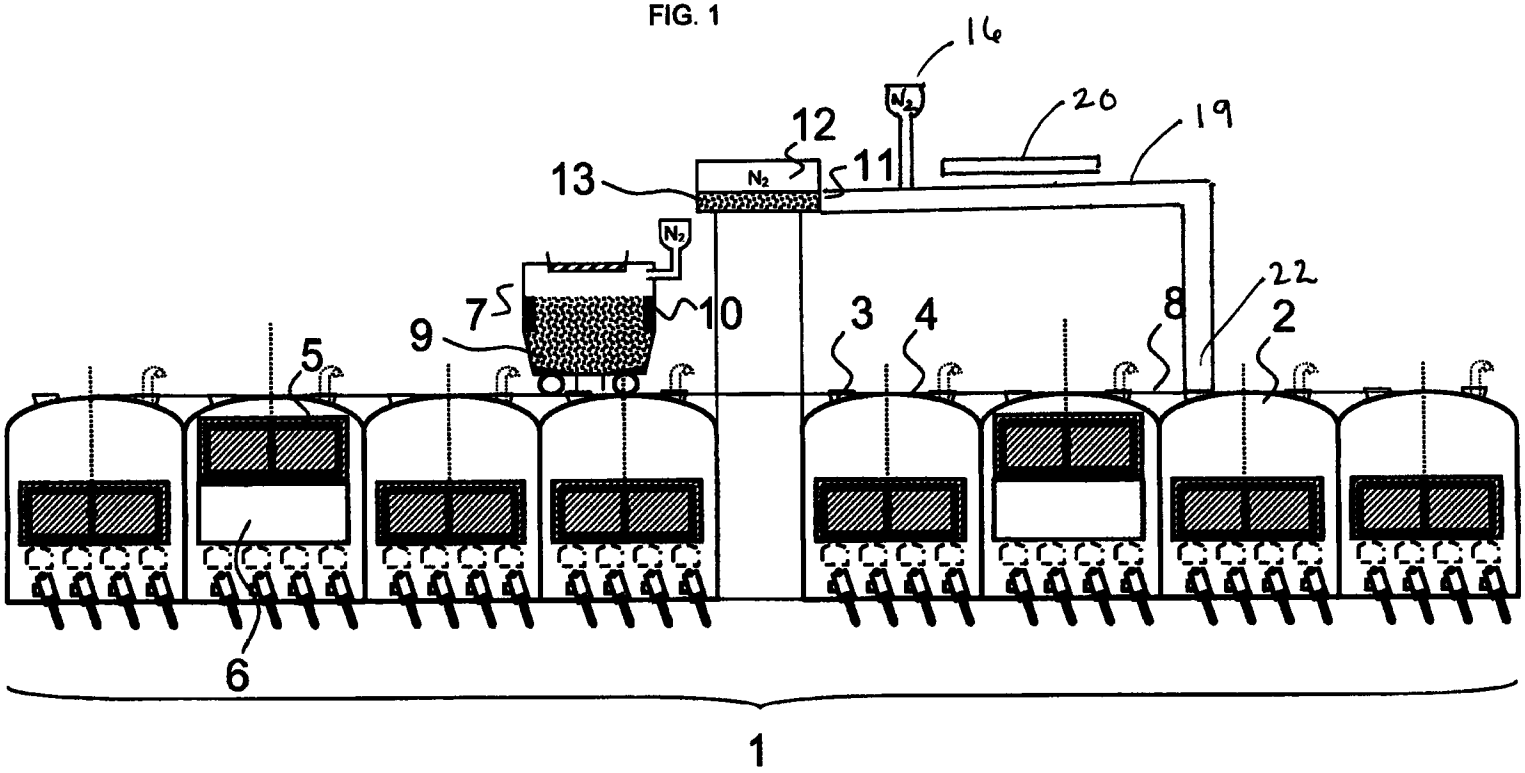
FIG. 1 illustrates a portion of a coke oven bank employing several embodiments of the invention.

Loading the coke oven chamber with pre-heated coal, whereby the coal is initially heated to a temperature of 100 to 400° C., allows for a situation where part of the volatile components has been outgassed already and the heating takes place in a hermetically sealed environment so that no coal is lost through combustion. Furthermore, because the pre-heated coal is filled using a means of transportation through the coke oven cover in a "heat-recovery" or "non-recovery" coke oven bank, whereby a specific load height is maintained, the swelling pressure can escape into the gas compartment over the coke cake.

At the elevated temperature of 100° C. to 400° C. the coal attains a quasi-fluid state that is characterised by fluid-like flow characteristics so that the coke oven banks can be filled in a particularly efficient and homogenous manner. This simplifies the management of the coking process and substantially improves the quality of the coke.

At the same time, the operating time necessary to coke the coal in a "heat-recovery" or "non-recovery" coke oven is substantially reduced, as a large share of the volatile coal components have already been released in an external unit even before the oven is loaded. This measure thus enhances the cost-effectiveness of the "heat-recovery" or "non-recovery" coking process.

Moreover, during loading the elaborate design and construction of the levelling door openings and the cross anchoring is unnecessary, substantially enhancing the cost-effectiveness of the process.

"Heat-recovery" or "non-recovery" coke oven banks are suitable for this process because their method of construction allows for a gas compartment over the coke cake that is intended for partial combustion of coking gas in the typical method of construction of this design. Coking ovens that are not of this design have no compartment or only a very small compartment for offgassing, so the swelling pressure cannot be immediately released. A list and explanation of examples of coke ovens in the "heat-recovery" or "non-recovery" designs are found in patent specifications U.S. Pat. No. 4,344,820 A, U.S. Pat. No. 4,287,024 A, U.S. Pat. No. 5,114,542 A, GB 1555400 A or CA 2052177 C. The heating also causes the water contained in the coal to outgas. Thus the coking can begin directly after loading and heating.

Warming coal for heat recovery and in order to improve the coking process is already known. DE 4204578 C2 describes processes for drying and pre-heating the feed coal through heat recovery from hot raw gas, which is characterised in that wet feed coal is brought by means of a counterflow into direct contact with raw gas that is cooled from an operating temperature of 700 to 900° C. to an outlet temperature of approximately 550° C. This process serves primarily to improve the energy effectiveness of the horizontal chamber coking, whereby the sensible heat is extracted from the coke and the raw gas as far as possible, and reintroduced into the process via the coal. The coal is initially pre-dried and then pre-heated according to the state and moisture content of the coal. Thus the degree of pre-drying and pre-heating can be set within broad limits.

DE 2706026 A1 describes a process for conveying pre-warmed feed coal into coking chambers and a system for conducting the process whereby the feed coal is pneumatically loaded above the middle of the coking chambers using a pressurized, neutral carrier medium, such as nitrogen, from one or several metering storage vessels, where the carrier medium is separated from the feed coal in an outgassing distributor and then distributed through gravity into one or more pipe chutes and into the coking chambers. The temperature of the pre-warmed coal can be 100 to 280° C., depending on the state of the art.

However, the process makes no mention of the use of "heat-recovery" or "non-recovery" coke oven banks in which coal could be loaded under inert gas at an elevated temperature. Neither does it describe how swelling pressure can be counteracted by the use of pre-heated coal. Pipe chutes are named as the exclusive transportation medium to be used. For the current invention, however, it is theoretically possible to use any means of transportation for pre-heated coal in which it can be loaded into coke oven chambers in a hermetically sealed environment.

It is important for the execution of the present invention process for the coal to reach a quasi-fluid state, depending on the type of coal, so that homogenous loading is possible. Also, the moisture content, the content of volatile coal components, the load weight, the height of the layer, the type of coal, the maceral group of the coal and the coking speed through pre-heating and homogenous loading no longer play a role.

In the process, the pre-heated coal can be produced in various ways. The coal is taken from one of the coal hoppers assigned to one of the coke oven banks in a preferred embodiment of the invention. Pre-heating can then take place, for instance, in an intermediate container. This can be in the form of a hopper, box or cone. Pipes for transporting hot solids are sufficiently known in the state of the art. In one embodiment of the invention, the coke oven chambers are loaded with the pre-heated coal from a coal hopper through pipes under inert gas. The coal can also be advantageously supplied through pre-heating in the pipe. In this process, the heating takes place under the inert gas, whereby the pipe is equipped with devices to allow for heating the coal. Degassers or distributors can be situated at any location in the pipes. These can be equipped with shutoff devices; for instance, valves or slides are suitable for this.

The coke oven chamber can also be filled with pre-heated coal from a coal hopper via conveyer belts under inert gas. The pre-heating can take place, for instance, in an intermediate container. This can be in the form of a hopper, box, or cone. Conveyer belts used to transport hot solids are sufficiently known in the state of the art. The coal can also be pre-heated on the conveyer belt. The conveyer belt or the housing of the conveyer belt are equipped with devices, according to this embodiment of the process, that allow for the coal to be heated. In one possible embodiment of the invention, the housing is equipped with a connection for introducing an inert gas.

The pre-heated coal can also be supplied from a coal hopper or coal container in which the coal is pre-heated. To this end the coal hopper, or a container that can also be designed as an intermediate container, is equipped with a device to heat the coal. For example the coal in the coal hopper or container can be heated by heat coils through which hot mediums flow, such as steam, exhaust or heated air.

The heating coils can be of any type; for instance, pipelines or radiators could be considered. Hot transfer mediums flow through the heating coils. They can be of any type and flow through the heating coils at a high temperature. The temperature can be at any level. In an advantageous embodiment of the invention, the temperature is over 200° C.

In one embodiment of the invention, the filling of the coke oven chamber with pre-heated coal from the coal hopper or a container is effected by a coal charging car under inert gas. For this, the coal can be heated either in the coal hopper or container or in the coal charging car. For instance, the pre-heated coal can be supplied from a coal charging car under inert gas, whereby the coal is heated in the coal charging car. If the heating takes place in the coal charging car, then the coal charging car is equipped with devices for the heating of the coal. These can be located in any part of the coal charging car. The coal charging car is equipped with loading devices and emptying connections for filling the coke oven chambers. Coal charging cars for filling coke oven chambers are sufficiently known in the state of the art. An example of a coal charging car with a device for lifting covers from filling hole frames in the furnace roof of a coke oven is found in WO 2009097984 A2.

In a typical embodiment of the invention, the coke oven chamber is filled with the pre-heated coal from a coal charging car, whereby the charging car establishes a canal-like connection between a pipeline carrying coal under inert gas or a conveyer belt and the oven fill hole to be filled.

In one design of the invention, a fluidised bed is used to warm the coal. In this process, fluidising is by means of either a heated, inert gas or low-oxygen gas from a downcomer of an end oven after it has been cooled down to 400° C. Such a gas can be subsequently transferred back to the lower oven or the upper oven of the end oven. It is also possible to use heat coils within the fluid bed.

The inert gas can be nitrogen, helium or argon. The coal or coke is heated here under inert gas. This is necessary to avoid combustion of the coal during heating. Handling the coal under inert gas is only necessary if the coal is heated. In the process, handling under inert gas is understood to mean adding the coal and covering the coal with the inert gas in such a quantity as to hinder the combustion or excessive reaction of the coal with air.

The coal can be heated in any of the above-mentioned transfer or storage mediums in any way. It is therefore possible to use burners or a hot gas. The hot gas can heat the coal either directly or in an indirect heat exchange. For instance, the coal can also be heated through induction, microwave or arc heating. These types of heating are suitably known in the state of the art. Examples of this are found in patent specifications DE 2812520 A1, GB 1089092 A, U.S. Pat. No. 4,389,283 A. The coal is pre-heated to a temperature of 100 to 400° C.

Loading of the coke oven chambers with the hot coal takes place in one embodiment of the invention through 1 to 4 fill holes in the coke oven cover. In the process, the coal charging car travels along the cover of the coke oven chambers and enables the coke oven chambers to be filled while covering the coal with the inert gas. Loading or transporting the heated coal can be temporary or permanent. This typically occurs according to a pre-determined plan of operation.

In one embodiment of the invention, the coke oven chamber is filled with the hot coal through 1 to 4 fill holes in the coke oven chamber cover. The coke oven charging car travels along the cover of the coke oven chambers and enables the coke oven chambers to be filled by establishing only a connecting pipeline between the pipeline carrying the coal and the fill holes to be filled, without an inert gas atmosphere. To this end at least two slides or other fittings are activated. The heated coal can be loaded or transported temporarily or permanently. This is typically undertaken according to a predetermined plan of operation.

In one embodiment of the invention the medium serving to heat the coal is taken from end ovens 1 to 6 of a coke oven bank near the coal tower and transferred back to an oven after it has been cooled.

The task of the invention is also solved with a device for coking coal with high swelling pressure characteristics in a "non-recovery" or "heat-recovery" coke oven bank with the use of a process according to one of the previous claims, including a coke oven bank or coke oven battery with a number of coke oven chambers which must be loaded through the coke oven chamber covers, a coal charging car that can travel along the top of the cover of a coke oven bank or battery and can fill at least one coke oven chamber, a coal hopper with which the coal charging car can be filled with coal, whereby the coal charging car can be filled, using suitable devices, with an inert gas whereby the coal charging car is equipped with coal loading connections that enable the combustion-free loading of the coke oven chambers without any air entering, and the coal charging car is equipped with a device to heat the coal One embodiment of the device provides for the coal charging car to be equipped with a sealable supply container for the inert gas.

One further embodiment of the device provides for the coke oven chamber to be filled with the pre-heated coal from a coal charging car, whereby the charging car is equipped with a canal-like connection between the pipeline carrying the coal with inert gas or the conveyer belt, and the oven fill hole to be filled, and the connection between the conveyer belt and the charging car and the fill hole is detachable with at least two sealable fittings such as slides, valves, bucket conveyers, screw conveyers or other fittings.

The coal charging car is equipped with a device for heating. This can be a more simple device according to the state of the art, such as burners or feed connections for hot gas. This can also be done through induction, microwave or arc heating in the coal charging car. The coal charging car can be equipped with at least one sealable feed connection for the inert gas. The coal charging car can also be equipped with a sealable supply container for the inert gas.

The invention has the advantage of effecting the loading of coke oven chambers in a manner that avoids an increase in swelling pressure in a coke oven chamber during coking. This enables the coking process to be made more cost-effective. In addition, disadvantages are avoided that are caused by excessive moisture content and disadvantageous content of volatile components of the coal.

The advantages of the invention are:

The operating time between two loading processes is substantially reduced, leading to an increase in equipment revenue and thus greater cost-effectiveness.

Types of coal with high swelling pressure characteristics that cannot be used in conventional horizontal chamber ovens and are thus less expensive to acquire can be used without any danger of damage being caused.

Design and construction complexity is reduced because the need for an expensive cross-anchoring system is obviated.

An otherwise necessary, expensive levelling system is also rendered unnecessary.

Figure 2:
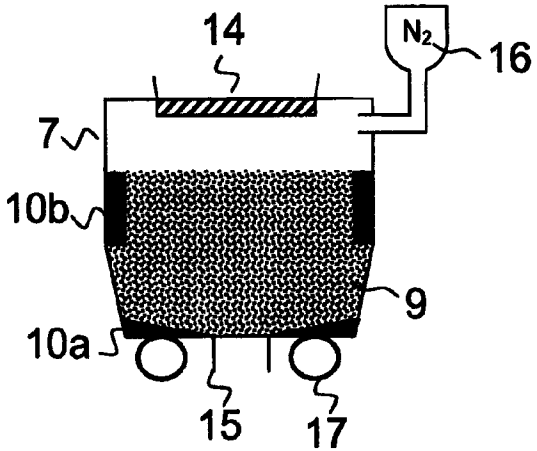
FIG. 2 illustrates a coal charging car in accordance with one embodiment of the invention.

The present invention device is explained more precisely using two figures, whereby these depict only possible embodiments of the invention. FIG. 1 shows a coke oven bank with the coal charging car for loading according to the present invention. FIG. 2 shows the coal charging car according to the present invention.

FIG. 1 shows a coke oven bank (1) consisting by way of example of a total of eight coke oven chambers (2) of the "heat-recovery" or "non-recovery" type. The coke oven chambers (2) are loaded through the filling holes (3) in the coke oven cover (4). Two of the coke oven chambers (2) are depicted in an open position after the emptying of the previous load, whereby the raised coke oven chamber door (5) is located above the coke oven chamber opening (6). The coke oven chambers (2) are loaded by the coal charging car (7), which travels along the cover (4) of the coke oven bank (1) on a guide rail (8), is positioned over the coke oven chamber to be filled (2) and loads the coke oven chamber to be filled (2) via a discharge nozzle with hot, pre-heated coal (9). The coke is heated in the coal charging car (7), which is equipped with a heating device (10). The coal charging car (7) is loaded from a coal hopper (11) situated above the level of the coal charging car. Loading takes place under an inert gas (12) that also surrounds the coal (13) in the coal hopper (11). The coal charging car (7) can also be placed under inert gas (12), so that the coal (9) can be transported to the coke oven chamber to be filled (2) without combustion.

FIG. 2 shows a coal charging car (7) equipped with an opening for filling (14) and two heating devices (10*a*,10*b*) with which the coal (9) can be pre-heated. Underneath the coal charging car (7) there is a discharge nozzle (15) through which the hot, pre-heated coal (9) can be loaded into the coke oven chamber to be filled (2). The coal charging car (7) is equipped with a supply container for inert gas (16) so that the hot, pre-heated coal (9) can be transported without combustion. The guide wheels (17) enable the car to travel along the guide rails (8).

Figure 3:
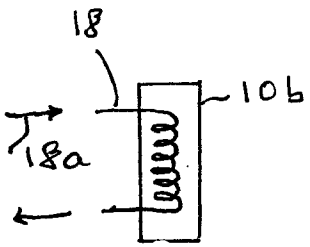
FIG. 3 illustrates one embodiment for a heater used in the coal charging care of FIG. 2.
Figure 4:
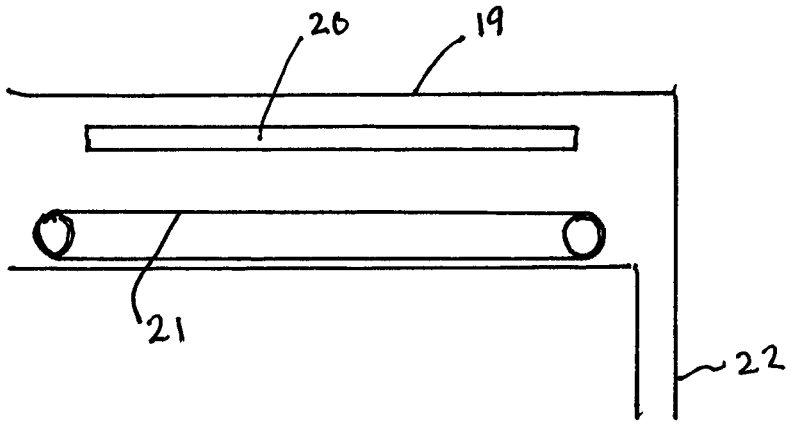
FIG. 4 illustrates an inertized pipeline and conveyor with optional heater.
Figure 5:
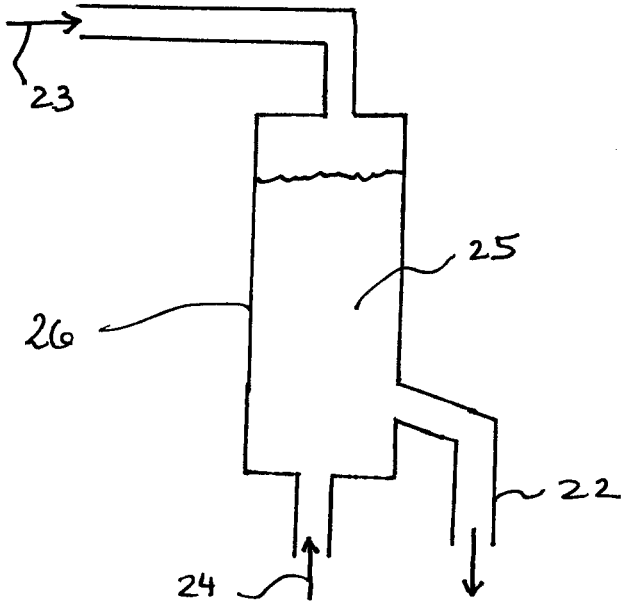
FIG. 5 illustrates schematically a fluidized bed heater for coal for use in one embodiment of the invention.

FIG. 1 also illustrates an alternative embodiment where coal from hopper 11 is transported through pipeline 19 under inert gas 16, ultimately flowing through discharge nozzle 22 into a coke oven. The coal may be preheated by optional heater 20. FIG. 2 shows a pipeline 19 containing a conveyor 21, optionally including heater 20. FIG. 3 shows one embodiment of the heater of coke charging car 7, wherein heater 10b is heated by hot medium 18a flowing through heating coil 18. FIG. 5 illustrates in schematic form an embodiment where coal 23, supplied from hopper 11 of FIG. 1, is directed to the top of fluidized bed heater 26, and the coal 25 in the bed is fluidized by hot inert gas 24, hot coal then being conveyed into a coke oven via discharge nozzle 22.

REFERENCE SYMBOL LIST

1 Coke oven bank
2 Coke oven chamber
3 Fill holes
4 Coke oven chamber cover
5 Coke oven chamber door
6 Coke oven chamber opening
7 Coal charging car
8 Guide rails
9 Hot, pre-heated coal
10 Upper heating device
10*a* Lower heating device
10*b* Heating device
11 Coal hopper
12 Inert gas
13 Coal
14 Opening for loading the coke car
15 Discharge nozzle for the coal charging car
16 Supply container for inert gas
17 Guide wheels

The invention claimed is:

1. A process for coking coal with high swelling characteristics in a non-recovery or heat-recovery coke oven bank, comprising:

a) coking coal cyclically in a coke oven bank comprising a plurality of coke oven chambers arranged in a row;

b) transporting the coal from a coal hopper to a designated coke oven chamber;

c) heating the coal to an elevated temperature of from 100° C. to 400° C. under an inert gas, to provide pre-heated coal prior to loading the coal into the coke oven chamber and loading the pre-heated coal into the coke oven chamber, under inert gas;

d) loading the pre-heated coal into the coke oven chamber at a constant fill height without additional levelling, such that a swelling pressure developed during coking is accommodated by a gas compartment within the coke oven chamber above a coal cake formed from the coal during coking;

e) coking the coal in the coke oven chamber to form coke and removing a coke cake thereby formed from the coke oven chamber.

2. The process of claim 1 wherein the loading of the coke oven chamber takes place with the pre-heated coal from a coal hopper using a pipeline under inert gas as a transport device.

3. The process of claim 2 wherein the coal is pre-heated in the pipeline.

4. The process of claim 1 wherein the loading of the coke oven chamber with the pre-heated coal takes place from a coal hopper using a conveyer belt under inert gas as a transport device.

5. The process of claim 4 wherein the coal is pre-heated on the conveyor belt.

6. The process of claim 1 wherein the coal is pre-heated in a fluidised bed.

7. The process of claim 1 wherein the coal is pre-heated in the coal hopper.

8. The process of claim 7 wherein the coal is heated in the coal hopper via heat coils through which flows a hot medium selected from the group consisting of steam, exhaust, raw coke oven gas, heated air or mixtures thereof.

9. The process of claim 8 wherein the medium serving to heat the coal is taken from an oven no more than 6 ovens distant from the coal hopper of a coke oven bank, and after the medium has been cooled, a cooled medium is transferred back to an oven.

10. The process of claim 1 wherein the coke oven chamber is filled with the pre-heated coal from the coal hopper under inert gas.

11. The process of claim 1 wherein the coke oven chamber is loaded with pre-heated coal from the coal hopper and the coke oven chambers are connected by a canal incorporating either a pipeline or a conveyer belt, both carrying the coal under the inert gas.

12. The process of claim 10 wherein pre-heated coal from the coal hopper is supplied under inert gas.

13. The process of claim 1 wherein the inert gas is nitrogen, helium or argon.

14. The process of claim 1 wherein the coal is heated by induction, microwave or arc heating.

15. The process of claim 1 wherein the coke oven chambers are filled with the pre-heated coal via 1 to 4 fill holes in a coke oven cover.

16. A device for coking coal with high swelling pressure characteristics in a "non-recovery" or "heat-recovery" coke oven bank using a process of claim 1, including (i) a coke oven bank or coke oven battery with a plurality of coke oven chambers, (ii) a coal charging car propellable along a cover of the coke oven bank or battery with which at least one coke oven chamber can be loaded, (iii) a coal hopper from which the coal charging car can be loaded with coal, wherein a) the coal charging car is loaded under inert gas, whereby the coal charging car is equipped with coal feed connections, and b) the coal charging car is equipped with a device for heating coal.

17. The device of claim 16 wherein the coal charging car is equipped with a sealable supply container for the inert gas.

18. The device according to claim 16 wherein the coke oven chamber is connected with the coal hopper by a supply channel incorporating either a pipeline or a conveyer belt.

* * * * *